United States Patent [19]

Grover et al.

[11] 4,339,272

[45] Jul. 13, 1982

[54] TUNGSTEN CARBIDE-BASED HARD METALS

[75] Inventors: Rajeev K. Grover, London; Eric Gillam, North Harrow, both of England

[73] Assignee: National Research Development Corporation, London, England

[21] Appl. No.: 162,949

[22] Filed: Jun. 25, 1980

[30] Foreign Application Priority Data

Jun. 29, 1979 [GB] United Kingdom ..... 7922642

[51] Int. Cl.[3] ..... C22C 29/00

[52] U.S. Cl. ..... 75/240; 51/309

[58] Field of Search ..... 75/240; 51/309, 307

[56] References Cited

U.S. PATENT DOCUMENTS

| | | | |
|---|---|---|---|
| 2,607,676 | 8/1952 | Kurtz | 75/240 |
| 3,816,081 | 6/1974 | Hale | 75/240 |
| 3,859,657 | 1/1975 | Stoll et al. | 75/240 |

OTHER PUBLICATIONS

Moskowitz et al., *Modern Developments in Powder Metallurgy*, vol. 5, edited by H. H. Hauser, Plenum Press, 1971, "High-Strength Tungsten Carbides".

*Primary Examiner*—Mark Bell

*Attorney, Agent, or Firm*—Oblon, Fisher, Spivak, McClelland & Maier

[57] ABSTRACT

A tungsten carbide-based hard metal comprises 75-97 weight % tungsten carbide. The balance is binder. To avoid using cobalt binder as is conventional, a typical binder composition is 14 weight % manganese, 2½% carbon, 5% nickel and balance iron.

6 Claims, No Drawings

TUNGSTEN CARBIDE-BASED HARD METALS

This invention relates to tungsten carbide-based hard metals.

A typical conventional tungsten carbide hard metal consists of 6 weight % cobalt and, as the balance, tungsten carbide particles of 1–2 microns size. It is desirable in present-day conditions to find an alternative to this cobalt.

According to the present invention, a tungsten carbide-based hard metal comprises 75–97 weight % (preferably 90–94%) tungsten carbide, of which 20% may be replaced by (an)other transition metal carbide(s), such as of tantalum or titanium, the balance being binder, the composition of the binder being 8–24 weight % (preferably 12–20%, more preferably 12–16%) manganese, carbon in an amount sufficient substantially to suppress formation of 'eta phase' but insufficient to form deleterious free graphite, and the remainder iron; a small amount (say 5%) of austenite stabiliser such as nickel may be added to the binder. It is suggested that the carbon may be from 2.5 to 3.5%, preferably 2.5 to 3.1%.

By 'eta phase' we mean the Fe-W-C phase, which is embrittling, analogous to the eta-phase in the Co-W-C system. The amount of carbon implicit in this definition is more than would be theoretically necessary merely to form an austenitic binder. Excess manganese is undesirable as specimens containing it can exude liquid on heating, causing distortion.

The hard metal is preferably prepared by sintering at a somewhat higher temperature than conventional for cobalt/tungsten carbide hard metals.

All percentages are by weight.

The invention will now be described by way of example.

In all examples, the method of preparation was as follows. Iron, and nickel when present, was obtained from the respective carbonyl. Nickel could also be of electrolytic origin, giving identical results. Manganese was of electrolytic origin, generally of about 2 micron grain size, but ranging from 1 to 15 microns. Carbon was thermal black as used in the hard metal industry. Tungsten carbide was prepared from hydrogen-reduced tungsten, carburised conventionally, containing 6.11% total carbon content (including 0.04% free carbon), and had a mean particle size of about 1 micron, and all particles smaller than 2 microns.

These powders, in the appropriate proportions, were ball-milled for 48 hours in acetone. The balls to powder ratio was 15 to 1. Then, as normal, $1\frac{1}{2}$% paraffin wax (in $CCl_4$) was added as a lubricant, and the resulting powder was sieved to −100 mesh B.S. The sieved powder was pressed to a compact in a single-action die to 150 MPa.

The compact was presintered at 850°–900° C. for 1 hour in a non-decarburising hydrogen atmosphere (containing 2% methane), and could then be machined if desired to such shapes as form tool tips, die nibs and punches.

The presintered compact was sintered in hydrogen for 1 hour (or, with comparable results, for 2 hours) at 1525° C. The sintered compact was then hot-isostatically pressed at 1 kbar at 1360° C. in argon for 1 hour. The pressed compact was then reheated to 1100° C. and water-quenched to give the desired product.

In Examples 1–8, the hard metal had the composition 94% tungsten carbide+6% binder. The compositions of the binders were as follows (in weight %):

Ex. 1: 14 Mn, 2.8C, balance Fe
Ex. 2: 20 Mn, 2.8C, balance Fe
Ex. 3: 20 Mn, 2.8C, 5 Ni, balance Fe
Ex. 4: 14 Mn, 2.8C, 5 Ni, balance Fe
Ex. 5: 14 Mn, 2.5C, balance Fe
Ex. 6: 14 Mn, 2.5C, 5 Ni, balance Fe
Ex. 7: 14 Mn, 3.1C, balance Fe
Ex. 8: 14 Mn, 3.1C, 5 Ni, balance Fe The porosities and microstructures of these hard metals were similar to those of K20 (a standard 94% WC+6% Co hard metal).

The Vickers hardnesses of the Examples (30 kg load) were respectively 1730, 1700, 1668, 1683, 1541, 1525, 1450 and 1456 (mean values), which are comparable to the 1598 found for the corresponding tungsten carbide/cobalt hard metal.

Machining (turning) tests of the Examples in accordance with ISO 3685 1977 showed broadly similar results to K20.

In Examples 9–16, the hard metal had the composition 90% tungsten carbide+10% binder. The compositions of the binders were as follows (weight %):

Ex. 9: 14 Mn, 2.8C, balance Fe
Ex. 10: 20 Mn, 2.8C, balance Fe
Ex. 11: 20 Mn, 2.8C, 5 Ni, balance Fe
Ex. 12: 14 Mn, 2.5C, balance Fe
Ex. 13: 14 Mn, 2.5C, 5 Ni, balance Fe
Ex. 14: 14 Mn, 2.8C, 5 Ni, balance Fe
Ex. 15: 14 Mn, 3.1C, balance Fe
Ex. 16: 14 Mn, 3.1C, 5 Ni, balance Fe Again, the porosities, microstructures, machining properties and hardnesses were all comparable to corresponding conventional hard metals containing 10% binder (all cobalt), the Vickers hardnesses (30 kg load) of the Examples being, respectively, 1560, 1525, 1540, 1465, 1480, 1548, 1430 and 1448 (mean values), compared with 1285 found for the corresponding 90% WC+10% Co hard metal.

The densities of the samples of twelve of the 16 Examples were determined, and of these ten were at least 99.50% of theoretical density.

What is claimed is:

1. A tungsten carbide-base hard metal, comprising

75–97 weight % tungsten carbide, of which 20% may be replaced by (an) other transition metal carbide(s), the balance being binder, characterized in that the composition of the binder itself is 8–24 weight % manganese, carbon in an amount of 2.5–3.5%, optionally up to 5% of an austenite stabiliser, and the remainder iron.

2. The hard metal of claim 1, comprising 90–94% tungsten carbide.

3. The hard metal of claim 1, wherein up to 20% of the tungsten carbide is replaced by any of tantalum carbide and titanium carbide.

4. The hard metal of claim 1, characterised in that the binder contains 12–20% manganese.

5. The hard metal of claim 4, characterised in that the binder contains 12–16% manganese.

6. The hard metal of claim 1, characterised in that the austenite stabiliser is nickel.

* * * * *